United States Patent [19]

Rodriguez et al.

[11] Patent Number: 4,834,775

[45] **Date of Patent: * May 30, 1989**

[54] PROCESS FOR CONTROLLING SULFUR-OXIDE FORMATION AND EMISSIONS WHEN BURNING A COMBUSTIBLE FUEL FORMED AS A HYDROCARBON IN WATER EMULSION

[75] Inventors: Domingo P. Rodriguez, Los Teques; Euler G. Jimenez, Caracas; Ignacio Layrisse, San Luis; Jose P. Salazar, San Antonio de Los Altos; Hercilio Rivas, Caracas, all of Venezuela

[73] Assignee: Intevep, S.A., Caracas, Venezuela

[ * ] Notice: The portion of the term of this patent subsequent to Jan. 31, 2006 has been disclaimed.

[21] Appl. No.: 14,871

[22] Filed: Feb. 17, 1987

Related U.S. Application Data

[63] Continuation-in-part of Ser. No. 875,450, Jun. 17, 1986.

[51] Int. Cl.[4] ..... C10L 1/32

[52] U.S. Cl. ..... 44/51; 252/312; 431/3; 431/4

[58] Field of Search ..... 431/3, 4; 44/51; 252/312

[56] References Cited

U.S. PATENT DOCUMENTS

| | | | |
|---|---|---|---|
| 2,845,338 | 7/1958 | Ryznar et al. | 44/5 |
| 3,332,755 | 7/1967 | Kukin . | |
| 3,519,006 | 7/1970 | Simmons et al. | 137/13 |
| 3,837,820 | 9/1974 | Kukin | 44/5 |
| 3,876,391 | 4/1975 | McCoy et al. | 44/51 |
| 3,902,869 | 9/1975 | Friberg et al. | 44/51 |
| 3,943,954 | 3/1976 | Flournoy et al. | 137/13 |
| 4,002,435 | 1/1977 | Wenzel et al. | 44/51 |
| 4,046,519 | 9/1977 | Piotrowski | 44/51 |
| 4,084,940 | 4/1978 | Lissant | 44/51 |
| 4,108,193 | 8/1978 | Flournoy et al. | 137/13 |
| 4,144,015 | 3/1979 | Berthiaume | 431/8 |
| 4,158,551 | 6/1979 | Feuerman | 44/51 |
| 4,162,143 | 7/1979 | Yount, III | 44/51 |
| 4,239,052 | 12/1980 | McClaflin | 137/13 |
| 4,315,755 | 2/1982 | Hellsten et al. | 44/51 |
| 4,382,802 | 5/1983 | Beinke et al. | 44/51 |
| 4,392,865 | 7/1983 | Grosse et al. | 44/51 |
| 4,416,610 | 11/1983 | Gallagher, Jr. | 431/4 |
| 4,445,908 | 5/1984 | Campere et al. | 44/51 |
| 4,477,258 | 10/1984 | Lepain | 44/51 |
| 4,488,866 | 12/1984 | Schirmer et al. | 431/4 |
| 4,512,774 | 4/1985 | Myers et al. | 44/51 |
| 4,570,656 | 2/1986 | Matlack et al. | 137/13 |
| 4,618,348 | 10/1986 | Hayes et al. | 431/4 |

FOREIGN PATENT DOCUMENTS

| | | |
|---|---|---|
| 56-159291 | 8/1981 | Japan . |
| 974042 | 11/1964 | United Kingdom . |

*Primary Examiner*—William R. Dixon, Jr.
*Assistant Examiner*—Margaret B. Medley
*Attorney, Agent, or Firm*—Bachman & LaPointe

[57] ABSTRACT

A process for controlling sulfur-oxide formation and emissions when burning a combustible fuel prepared from a hydrocarbon containing sulfur comprising forming a hydrocarbon in water emulsion and adding to the hydrocarbon in water emulsion a water soluble additive selected from the group consisting of $Na^+$, $K^+$, $Li^+$, $Ca^{++}$, $Ba^{++}$, $Mg^{++}$, $Fe^{+++}$ and mixtures thereof so as to obtain $SO_2$ emission levels upon combustion of said emulsion of less than or equal to 1.50 LB/MMBTU.

13 Claims, No Drawings

PROCESS FOR CONTROLLING SULFUR-OXIDE FORMATION AND EMISSIONS WHEN BURNING A COMBUSTIBLE FUEL FORMED AS A HYDROCARBON IN WATER EMULSION

CROSS REFERENCE TO RELATED APPLICATIONS

This application is a Continuation-In-Part of application Ser. No. 875,450, filed June 17, 1986.

BACKGROUND OF THE INVENTION

The present invention relates to a process for the preparation of liquid fuels and, more particularly, a process that allows a high sulfur fuel to be converted into energy by combustion with a substantial reduction in sulfur oxide emissions.

Low gravity, viscous hydrocarbons found in Canada, The Soviet Union, United States, China and Venezuela are normally liquid with viscosities ranging from 10,000 to 200,000 CP and API gravities of less than 12. These hydrocarbons are currently produced either by mechanical pumping, steam injection or by mining techniques. Wide-spread use of these materials as fuels is precluded for a number of reasons which include difficulty in production, transportation and handling of the material and, more importantly, unfavorable combustion characteristics including high sulfur oxide emissions and unburned solids. To date, there are two commercial processes practiced by power plants to reduce sulfur oxide emissions. The first process is furnace limestone injection wherein limestone injected into the furnace reacts with the sulfur oxides to form solid sulfate particles which are removed from the flue gas by conventional particulate control devices. The cost for burning a typical high sulfur fuel by the limestone injection method is between two to three dollars per barrel and the amount of sulfur oxides removed by the method is in the neighborhood of 50%. A more effective process for removing sulfur oxides from power plants comprises flue gas desulfurization wherein $CaO+H_2O$ are mixed with the flue gases from the furnace. In this process 90% of the sulfur oxides are removed; however, the cost for burning a barrel of fuel using the process is between four and five Dollars per barrel. Because of the foregoing, the high sulfur content, viscous hydrocarbons have not been successfully used on a commercial basis as fuels due to the high costs associated with their burning.

Naturally it would be highly desirable to be able to use the hydrocarbons of the type set forth above as a a fuel.

Accordingly, it is a principal object of the present invention to provide a process for the production of a combustible fuel from bitumens and residual fuel oils.

It is a particular object of the present invention to produce a liquid fuel from natural bitumens and residual fuel oils by forming an oil in water emulsion.

It is a further object of the present invention to provide an oil in water emulsion for use as a liquid fuel having characteristics for optimizing the combustion process.

It is a still further object of the present invention to provide optimum burning conditions for the combustion of an oil in water emulsion of natural bitumens and residual fuels so as to obtain excellect combustion efficiency, low unburned particulate solids and low sulfur oxide emissions.

Further objects and advantages of the present invention will appear hereinbelow.

SUMMARY OF THE INVENTION

The present invention relates to a process for burning a combustible fuel in the form of an oil in water emulsion, and, more particularly a process for controlling sulfur oxide formation and emissions when burning a sulfur containing hydrocarbon as an oil in water emulsion.

It is well known in the art to form oil in water emulsions either from naturally occurring bitumens or residual oil in order to facilitate the production and/or transportation of these viscous hydrocarbons. Typical processes are disclosed in U.S. Pat. Nos. 3,380,531; 3,467,195; 3,519,006; 3,943,954; 4,099,537; 4,108,193; 4,239,052 and 4,570,656. In addition to the foregoing, the prior art teaches that oil in water emulsions formed from naturally occurring bitumens and or residual oils can be used as combustible fuels. See for example U.S. Pat. Nos. 4,144,015; 4,378,230 and 4,618,348.

The present invention is drawn to a process for controlling sulfur-oxide formation and emissions when burning a combustible fuel prepared as an emulsion of a sulfur containing hydrocarbon, either a naturally occurring bitumen or a residual fuel oil, in water. In accordance with the present invention, a hydrocarbon and water is admixed with an emulsifier to form a hydrocarbon in water emulsion. The water content, which generally depends on the type of hydrocarbon (heavy or light) being used, is generally 5 to 40% by volume. As the emulsion is being used as a combustible fuel the water content is preferably less than 30% by volume. The emulsifying agent, which is selected from any well known agent, is preferably present in an amount of between 0.1 to 5.0% by weight based on the total weight of oil in water emulsion. The emulsion may be prepared in the manner described in any of the prior art patents referred to above.

In accordance with the present invention, an additive which captures sulfur and prohibits the formation and the emission of sulfur oxides during combustion of the hydrocarbon in water emulsion is added to the emulsion prior to the combustion of same. The preferred additives for use in the process of the present invention are water soluble and are selected from the group consisting of $Na+$, $K+$, $Li+$, $Ca++$, $Ba++$, $Mg++$, $Fe+++$ and mixtures thereof. The additive is added to the emulsion in a molar ratio amount of additive to sulfur in said hydrocarbon so as to obtain $SO_2$ emissions upon combustion of the emulsion of less than or equal to 1.50 lb/MMBTU. It has been found that in order to obtain the desired emissions level the additive must be present in a molar ratio of additive to sulfur of greater than or equal to 0.050, preferably 0.100, in the hydrocarbon in water emulsion. While the level of additive to obtain the desired result depends on the particular additive or combination of additives employed it has been found that a molar ratio of at least 0.050 of additive to sulfur is required.

The emulsion as prepared above is then burned under the following conditions: fuel temperature (°F.) of 60 to 176, preferably 68 to 140, steam/fuel ratio (wt/wt) of 0.05 to 0.5, preferably 0.50 to 0.4, air/fuel ratio (wt/wt) of 0.05 to 0.4, preferably 0.05 to 0.3, and steam pressure (Bar) of 1.5 to 6, preferably 2 to 4, or air pressure (Bar) of 2 to 7, preferably 2 to 4.

In accordance with the present invention it has been found that the oil in water emulsion fuel produced in the process of the present invention when conditioned in accordance with the present invention and burned under controlled operating conditions results in a combustion efficiency of 99.9%, a low particulate solids content and sulfur oxide emissions consistent with that obtained when burning traditional No. 6 fuel oil. In addition, the amount of sulfur eliminated is in excess of 90%.

DETAILED DESCRIPTION

In accordance with the present invention, the process of the present invention is drawn to the preparation and burning of a fuel formed from a naturally occurring bitumen or residual fuel oil product. One of the fuels for which the process is suitable is a bitumen crude oil having a high sulfur content such as those crudes typically found in the Orinoco Belt of Venezuela. The bitumen or residual oil has the following chemical and physical properties: C wt.% of 78.2 to 85.5, H wt.% of 9.0 to 10.8, O wt.% of 0.2 to 1.3, N wt.% of 0.50 to 0.70, S wt.% of 2 to 4.5, Ash wt.% of 0.05 to 0.33, Vanadium, ppm of 50 to 1000, Nickel, ppm of 20 to 500, Iron, ppm of 5 to 60, Sodium, ppm of 30 to 200, Gravity, °API of 1.0 to 12.0, Viscosity (CST), 122° F. of 1,000 to 5,100,000, Viscosity (CST), 210° F. of 40 to 16,000, LHV (BTU/lb) of 15,000 to 19,000, and Asphaltenes wt.% of 9.0 to 15.0. In accordance with the present invention, a mixture comprising water and an emulsifying additive is mixed with a viscous hydrocarbon or residual fuel oil so as to form an oil in water emulsion. It is a critical feature of the present invention that the characteristics of the oil in water emulsion be such as to optimize combustion of the oil in water emulsion. The oil in water emulsion should be characterized by a water content of about between 5 to 40 vol.%, preferably about between 15 to 35 vol.%. In accordance with the present invention, an additive which captures sulfur and prohibits the formation and the emission of sulfur oxides during combustion of the hydrocarbon in water emulsion is added to the emulsion prior to the combustion of same. The preferred additives for use in the process of the present invention are water soluble and are selected from the group consisting of $Na+$, $K+$, $Li+$, $Ca++$, $Ba++$, $Mg++$, $Fe+++$ and mixtures thereof. The additive is added to the emulsion in a molar ratio amount of additive to sulfur in said hydrocarbon so as to obtain $SO_2$ emissions upon combustion of the emulsion of less than or equal to 1.50 lb/MMBTU. It has been found that in order to obtain the desired emissions level the additive must be present in a molar ratio of additive to sulfur of greater than or equal to 0.050, preferably 0.100, in the hydrocarbon in water emulsion. While the level of additive to obtain the desired result depends on the particular additive or combination of additives employed it has been found that a molar ratio of at least 0.050 of additive to sulfur is required.

As noted above, the water also contains an emulsifier additive. The emulsifier is added so as to obtain an amount of about between 0.1 to 5.0 wt.%, preferably from about between 0.1 to 1.0 wt.%, based on the total weight of the oil in water emulsion produced. In accordance with the present invention, the emulsifier additive is selected from the group consisting of anionic surfactants, non-ionic surfactants, cationic surfactants, mixtures of anionic and non-ionic surfactants and mixtures of cationic and non-ionic surfactants. The non-ionic surfactants suitable for use in the process are selected from the group consisting of ethoxylated alkyl phenols, ethoxylated alcohols, ethoxylated sorbitan esters and mixtures thereof. Suitable cationic surfactants are selected from the group consisting of the hydrochlorides of fatty diamines, imidazolines, ethoxylated amines, amido-amines, quaternary ammonium compounds and mixtures thereof while suitable anonic surfactants are selected from the group consisting of long chain carboxylic, sulphonic acids and mixtures thereof. A preferred surfactant is a non-ionic surfactant with a hidrophilic-lipophilic balance of greater than 13 such as nonylphenol oxialkylated with 20 ethylene oxide units. Preferred anionic surfactants are selected from the group consisting of alkylaryl sulfonate, alkylaryl sulfate and mixtures thereof.

It has been found that the content of the sulfur capturing additive in the oil in water emulsion has a great effect on its combustion characteristics, particularly on sulfur oxide emissions. It is believed that, due to high interfacial bitumen-water surface to volume ratio, the additives react with sulfur compounds present in the fuel to produce sulfides such as sodium sulfide, potassium sulfide, magnesium sulfide and calcium sulfide, etc. During combustion, these sulfides are oxidized to sulfates thus fixing sulfur to the combustion ashes and thus preventing sulfur from going into the atmosphere as part of the flue gases. The amount of additive required depends on (1) the amount of sulfur in the hydrocarbon, and (2) the particular additive being used.

Once the oil in water emulsion is conditioned it is ready for burning. Any conventional oil gun burner can be employed such as an internal mixing burner or other twin fluid atomizers. Atomization using steam or air under the following operating conditions is preferred: fuel temperature (° F.) of 60 to 176, preferably 60 to 140, steam/fuel ratio (wt/wt) of 0.05 to 0.5, preferably 0.05 to 0.4, air/fuel ratio (wt/wt) of 0.05 to 0.4, preferably 0.05 to 0.3, and steam pressure (Bar) of 1.5 to 6, preferably 2 to 4, or air pressure (Bar) of 2 to 7, preferably 2 to 4. Under these conditions excellent atomization and efficient combustion was obtained coupled with good flame stablility.

Advantages of the present invention will be made clear from a consideration of the following examples.

EXAMPLE I

In order to demonstrate the effect of the additive of the present invention on the combustion characteristics of the oil in water emulsions of the present invention, seven bitumen in water emulsions were prepared having the compositional characteristics set forth below in Table I.

TABLE I

| | FUEL CHARACTERISTICS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| ADDITIVE/SULFUR (MOLAR/RATIO) | 0 | 0.011 | 0.019 | 0.027 | 0.036 | 0.097 | 0.035 |

TABLE I-continued

| | FUEL CHARACTERISTICS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| Na (% molar) | 0 | 95.4 | 95.4 | 95.4 | 95.4 | 95.4 | 95.4 |
| K ( % molar) | 0 | 0.7 | 0.7 | 0.7 | 0.7 | 0.7 | 0.7 |
| Li (% molar) | 0 | 1.4 | 1.4 | 1.4 | 1.4 | 1.4 | 1.4 |
| Mg (% molar) | 0 | 2.5 | 2.5 | 2.5 | 2.5 | 2.5 | 2.5 |
| LHV (BTU/LB) | 13337 | 13277 | 13158 | 13041 | 12926 | 12900 | 12900 |
| VOL % OF BITUMEN | 78.0 | 77.9 | 77.7 | 77.5 | 77.3 | 70 | 70 |
| VOL % OF WATER | 22.0 | 22.1 | 22.3 | 22.5 | 22.7 | 30 | 30 |
| WT. % OF SULFUR | 3.0 | 3.0 | 3.0 | 3.0 | 2.9 | 2.7 | 2.7 |

Combustion tests were conducted under the operating conditions set forth in Table II.

TABLE II

| | OPERATING CONDITIONS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| FEED RATE (LB/H) | 59.9 | 60.0 | 60.1 | 60.3 | 60.4 | 63.7 | 63.7 |
| THERMAL INPUT (MMBTU/H) | 0.82 | 0.82 | .0.82 | 0.82 | 0.82 | 0.82 | 0.82 |
| FUEL TEMPERATURE (°F.) | 154 | 154 | 154 | 154 | 154 | 154 | 152 |
| STEAM/FUEL RATIO (W/W) | 0.30 | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 | 2.4 |
| MEAN DROPLET SIZE (μm) | 14 | 14 | 14 | 14 | 14 | 14 | 14 |

The combustion characteristics are summarized in Table III below.

TABLE III

| | COMBUSTION CHARACTERISTICS | | | | | | |
|---|---|---|---|---|---|---|---|
| | BASELINE EMULSION | EMULSION #1 | EMULSION #2 | EMULSION #3 | EMULSION #4 | EMULSION #5 | EMULSION #6 |
| $CO_2$ (vol. %) | 13.0 | 12.9 | 13.1 | 13.0 | 13.0 | 12.9 | 13.2 |
| CO (ppm) | 36 | 27 | 41 | 30 | 38 | 20 | 40 |
| $O_2$ (vol. %) | 3.0 | 2.9 | 3.0 | 3.0 | 3.0 | 3.0 | 3.0 |
| $SO_2$ (ppm) | 2347 | 1775 | 1635 | 1516 | 1087 | 165 | 1120 |
| $SO_2$ (LB/MMBTU) | 4.1 | 3.1 | 2.9 | 2.7 | 4.9 | 0.3 | 2.0 |
| $SO_3$ (ppm) | 10 | 9 | 8 | 8 | 5 | 5 | 5 |
| NOx (ppm) | 450 | 498 | 480 | 450 | 432 | 434 | 420 |
| *$SO_2$ REDUCTION (%) | — | 24.4 | 30.3 | 35.4 | 53.7 | 93.1 | 52.3 |
| **COMBUSTION EFFICIENCY (%) | 99.8 | 99.8 | 99.5 | 99.8 | 99.9 | 99.9 | 99.9 |

$$*SO_2\ \text{REDUCTION}\ (\%) = \frac{SO_2\ \text{BASELINE} - SO_2\ \text{EMULSION}\ \#}{SO_2\ \text{BASELINE}} \times 100$$

**BASED ON CARBON CONVERSION

Table III clearly indicates that as the ratio of additive to sulfur increases the combustion efficiency of the emulsified hydrocarbon fuels improves to 99.9%. In addition to the foregoing, the comparative data of Table III shows that $SO_2$ and $SO_3$ emission levels improve as the additive to sulfur ratio increases. As can be seen from emulsion No. 5, the efficiency of $SO_2$ removal is in excess of 90% at an additive to sulfur ratio of 0.097. In addition, the sulfur oxide emissions in LB/MMBTU is far less than the 1.50 LB/MMBTU obtained when burning No. 6 fuel oil. In addition, the burning of said optimized oil in water emulsions leads to a substantial decrease of sulfur trioxide formation thus preventing corrosion of heat transfer surfaces due to sulfuric acid condensation (low temperature corrosion). Furthermore, the burning of said optimized oil in water emulsion leads to the formation of high melting point ashes thus preventing corrosion of heat transfer surfaces due to vanadium attack (high temperature corrosion). Note that the primary additive in these tests is sodium.

In addition, comparison of emulsions No. 4 and No. 6, burned with same additive to sulfur molar ratio, shows that dilution of bitumen in the aqueous phase (from 77.3 to 70.0 percent volume) has no effect on combustion characteristics while rendering equivalent $SO_2$ reduction (53.7 vs. 52.3 percent).

EXAMPLE II

Six additional oil in water emulsions were prepared employing the same bitumen of Example I. The compositional characteristics of these emulsions are set forth in Table IV below.

TABLE IV

| | FUEL CHARACTERISTICS | | | | | |
|---|---|---|---|---|---|---|
| | BASELINE EMULSION | EMULSION #7 | EMULSION #8 | EMULSION #9 | EMULSION #10 | EMULSION #11 |
| ADDITIVE/SULFUR | — | 0.014 | 0.027 | 0.035 | 0.044 | 0.036 |

TABLE IV-continued

| | FUEL CHARACTERISTICS | | | | | |
|---|---|---|---|---|---|---|
| | BASELINE EMULSION | EMULSION #7 | EMULSION #8 | EMULSION #9 | EMULSION #10 | EMULSION #11 |
| (MOLAR/RATIO) | | | | | | |
| Na (% molar) | 0 | 95.4 | 95.4 | 95.4 | 95.4 | 95.4 |
| K (% molar) | 0 | 0.7 | 0.7 | 0.7 | 0.7 | 0.7 |
| Li (% molar) | 0 | 1.4 | 1.4 | 1.4 | 1.4 | 1.4 |
| Mg (% molar) | 0 | 2.5 | 2.5 | 2.5 | 2.5 | 2.5 |
| LHV (BTU/LB) | 13083 | 12739 | 12429 | 12119 | 11826 | 12900 |
| VOL % OF BITUMEN | 76 | 74 | 72.2 | 70.4 | 68.7 | 70 |
| VOL % OF WATER | 24 | 26 | 27.8 | 29.6 | 31.3 | 30 |
| WEIGHT % OF SULFUR | 2.9 | 2.8 | 2.8 | 2.7 | 2.6 | 2.7 |

These emulsions were combusted under the operating conditions set forth in Table V.

TABLE V

| | OPERATING CONDITIONS | | | | | |
|---|---|---|---|---|---|---|
| | BASELINE EMULSION | EMULSION #7 | EMULSION #8 | EMULSION #9 | EMULSION #10 | EMULSION #11 |
| FEED RATE (LB/H) | 55.1 | 56.5 | 57.8 | 59.4 | 60.9 | 63.7 |
| THERMAL INPUT (MMBTU/H) | 0.75 | 0.75 | 0.75 | 0.75 | 0.75 | 0.82 |
| FUEL TEMPERATURE (°F.) | 149 | 149 | 149 | 149 | 149 | 154 |
| STEAM/FUEL RATIO (W/W) | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 |
| MEAN DROPLET SIZE (μm) | 32 | 32 | 32 | 32 | 32 | 32 |

The combustion characteristics are summarized in Table VI.

TABLE VI

| | COMBUSTION CHARACTERISTICS | | | | | |
|---|---|---|---|---|---|---|
| | BASELINE EMULSION | EMULSION #7 | EMULSION #8 | EMULSION #9 | EMULSION #10 | EMULSION #11 |
| $CO_2$ (vol. %) | 14.0 | 14.0 | 14.0 | 13.5 | 13.2 | 13.5 |
| CO (ppm) | 73 | 30 | 163 | 94 | 197 | 18 |
| $O_2$ (vol. %) | 3.0 | 2.7 | 2.9 | 2.9 | 3.1 | 3.0 |
| $SO_2$ (ppm) | 2133 | 1824 | 940 | 1109 | 757 | 1134 |
| $SO_2$ (LB/MMBTU) | 3.2 | 2.8 | 1.4 | 1.7 | 1.2 | 1.7 |
| $SO_3$ (ppm) | 13 | 9 | 7 | 5 | 2 | 6 |
| NOx (ppm) 209 | 128 | 182 | 114 | 73 | 110 | |
| *$SO_2$ REDUCTION (%) | — | 14.5 | 56.0 | 48.0 | 64.5 | 51.7 |
| **COMBUSTION EFFICIENCY (%) | 99.9 | 99.8 | 99.9 | 99.8 | 99.9 | 99.9 |

$$*SO_2\ \text{REDUCTION}\ (\%) = \frac{SO_2\ \text{BASELINE} - SO_2\ \text{EMULSION}\ \#}{SO_2\ \text{BASELINE}} \times 100$$

**BASED ON CARBON CONVERSION

Again, it is clear from Table VI that an increase in additive to sulfur ratio results in improved combustion efficiency and superior sulfur oxide emissions. Note that sodium was the primary element in the additive.

In addition, Comparison of emulsion No. 11 with emulsion No. 6 from previous example, both burned at identical thermal input (0.82 MMBTU/H), shows that the difference in mean droplet size (34 vs. 14 um) does not affect combustion characteristics while rendering equivalent $SO_2$ captures (51.7 vs. 52.3 percent) when burned with same additive to sulfur molar ratio.

Further, a comparison of emulsions No. 9 and No. 11, shows that $SO_2$ capture does not depend on thermal input.

EXAMPLE III

Seven further oil in water emulsions were prepared employing a residual fuel oil as the viscous hydrocarbon. The compositional characteristics of these emulsions are set forth below in Table VII.

TABLE VII

| | FUEL CHARACTERISTICS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| ADDITIVE/SULFUR (MOLAR/RATIO) | — | 0.10 | 0.20 | 0.30 | 0.50 | 0.68 | 0.78 |
| Mg (% molar) | 0 | 99.0 | 99.0 | 99.0 | 99.0 | 99.0 | 99.0 |
| Ca (% molar) | 0 | 0.25 | 0.25 | 0.25 | 0.25 | 0.25 | 0.25 |
| Ba (% molar) | 0 | 0.25 | 0.25 | 0.25 | 0.25 | 0.25 | 0.25 |
| Fe (% molar) | 0 | 0.5 | 0.5 | 0.5 | 0.5 | 0.5 | 0.5 |
| LHV (BTU/LB) | 13086 | 12553 | 12223 | 12223 | 11706 | 11189 | 10845 |
| VOL % OF BITUMEN | 76 | 73 | 71 | 74 | 68 | 65 | 63 |
| VOL % OF WATER | 24 | 27 | 29 | 26 | 32 | 35 | 37 |
| WT. % OF SULFUR | 2.9 | 2.8 | 2.7 | 2.8 | 2.6 | 2.5 | 2.4 |

Combustion tests were run under the following operating conditions.

TABLE VIII

| | OPERATING CONDITIONS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| FEED RATE (LB/H) | 55.1 | 57.2 | 59.2 | 59.2 | 62 | 64.7 | 66 |
| THERMAL INPUT (MMBTU/H) | 0.75 | 0.75 | 0.75 | 0.75 | 0.75 | 0.75 | 0.75 |
| FUEL TEMPERATURE (°F.) | 149 | 149 | 149 | 149 | 149 | 149 | 149 |
| STEAM/FUEL RATIO (W/W) | 0.30 | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 | 2.4 |
| MEAN DROPLET SIZE (μm) | 32 | 32 | 32 | 32 | 32 | 32 | 32 |

The combustion characteristics are summarized in Table IX below.

TABLE IX

| | COMBUSTION CHARACTERISTICS | | | | | | |
|---|---|---|---|---|---|---|---|
| | BASELINE EMULSION | EMULSION #12 | EMULSION #13 | EMULSION #14 | EMULSION #15 | EMULSION #16 | EMULSION #17 |
| $CO_2$ (vol. %) | 13.5 | 13.4 | 14 | 14 | 13.5 | 14 | 13.2 |
| CO (ppm) | 61 | 30 | 60 | 18 | 10 | 13 | 10 |
| $O_2$ (vol. %) | 3.0 | 3.2 | 2.9 | 2.6 | 3.2 | 2.9 | 3 |
| $SO_2$ (ppm) | 2357 | 1650 | 1367 | 1250 | 940 | 500 | 167 |
| $SO_2$ (LB/MMBTU) | 3.6 | 2.5 | 2.1 | 1.9 | 1.4 | 0.8 | 0.3 |
| $SO_3$ (ppm) | 18 | 16 | 9 | 8 | 7 | 6 | nil |
| NOx (ppm) | 500 | 510 | 400 | 430 | 360 | 240 | 218 |
| *$SO_2$ REDUCTION (%) | — | 30.0 | 42.0 | 47.0 | 60.0 | 79.0 | 93.0 |
| **COMBUSTION EFFICIENCY (%) | 99.9 | 99.9 | 99.9 | 99.9 | 99.9 | 99.9 | 99.8 |

$$*SO_2\ \text{REDUCTION}\ (\%) = \frac{SO_2\ \text{BASELINE} - SO_2\ \text{EMULSION}\ \#}{SO_2\ \text{BASELINE}} \times 100$$

**BASED ON CARBON CONVERSION

Table IX again clearly indicates, as did Tables III and IV, that as the ratio of additive to sulfur increases the combustion efficiency of the emulsified hydrocarbon fuels improves. In addition, Table IX clearly shows that sulfur oxide emission levels decrease as the additive to sulfur ratio increases. Again it can be seen from emulsions 16 and 17 that sulfur oxide emissions obtained are less than that attainable when burning No. 6 fuel oil.

EXAMPLE IV

An additional six oil in water emulsions were prepared using a high sulfur No. 6 fuel oil as the hydrocarbon component. The compositional characteristics of these emulsions are set forth below in Table X.

TABLE X

| | FUEL CHARACTERISTICS | | | | | |
|---|---|---|---|---|---|---|
| | BASELINE EMULSION | EMULSION #18 | EMULSION #19 | EMULSION #20 | EMULSION #21 | EMULSION #22 |
| ADDITIVE/SULFUR (MOLAR/RATIO) | — | 0.007 | 0.019 | 0.032 | 0.045 | 0.15 |
| Na (% molar) | 0 | 95.4 | 95.4 | 95.4 | 95.4 | 95.4 |
| K (% molar) | 0 | 0.7 | 0.7 | 0.7 | 0.7 | 0.7 |
| Li (% molar) | 0 | 1.4 | 1.4 | 1.4 | 1.4 | 1.4 |
| Mg (% molar) | 0 | 2.5 | 2.5 | 2.5 | 2.5 | 2.5 |
| LHV (BTU/LB) | 13215 | 13215 | 13215 | 13215 | 13215 | 12686 |
| VOL % OF FUEL | 75 | 75 | 75 | 75 | 75 | 72 |
| VOL % OF WATER | 25 | 25 | 25 | 25 | 25 | 28 |
| WT. % OF SULFUR | 1.9 | 1.9 | 1.9 | 1.9 | 1.9 | 1.9 |

Combustion tests were conducted under the operating conditions set forth in Table XI.

TABLE XI

| | OPERATING CONDITIONS | | | | | |
|---|---|---|---|---|---|---|
| | BASELINE EMULSION | EMULSION #18 | EMULSION #19 | EMULSION #20 | EMULSION #21 | EMULSION #22 |
| FEED RATE (LB/H) | 54.5 | 54.5 | 54.5 | 54.5 | 54.5 | 56.8 |
| THERMAL INPUT (MMBTU/H) | 0.75 | 0.75 | 0.75 | 0.75 | 0.75 | 0.75 |
| FUEL TEMPERATURE (°F.) | 149 | 149 | 149 | 149 | 149 | 149 |
| STEAM/FUEL RATIO (W/W) | 0.30 | 0.30 | 0.30 | 0.30 | 0.30 | 0.30 |
| STEAM PRESSURE (BAR) | 2.4 | 2.4 | 2.4 | 2.4 | 2.4 | 2.4 |
| MEAN DROPLET SIZE (μm) | 34 | 34 | 34 | 34 | 34 | 34 |

The combustion characteristics and these emulsions are summarized in Table XII.

TABLE XII

| | COMBUSTION CHARACTERISTICS | | | | | |
|---|---|---|---|---|---|---|
| | BASELINE EMULSION | EMULSION #18 | EMULSION #19 | EMULSION #20 | EMULSION #21 | EMULSION #22 |
| $CO_2$ (vol. %) | 14.3 | 14.2 | 14.1 | 14.2 | 14.0 | 13.9 |
| CO (ppm) | 10 | 12 | 8 | 14 | 10 | 8 |
| $O_2$ (vol. %) | 2.9 | 2.9 | 3 | 2.8 | 2.9 | 3 |
| $SO_2$ (ppm) | 1730 | 1522 | 1384 | 1176 | 858 | 62 |
| $SO_2$ (LB/MMBTU) | 2.5 | 2.2 | 2.0 | 1.7 | 1.2 | 0.1 |
| $SO_3$ (ppm) | 12 | 14 | 8 | 8 | 9 | nil |
| NOx (ppm) | 210 | 212 | 209 | 215 | 214 | 223 |
| *$SO_2$ REDUCTION (%) | — | 12.0 | 20.0 | 32.0 | 50.4 | 96.4 |
| **COMBUSTION EFFICIENCY (%) | 99.8 | 99.9 | 99.9 | 99.9 | 99.9 | 99.9 |

$$*SO_2 \text{ REDUCTION } (\%) = \frac{SO_2 \text{ BASELINE} - SO_2 \text{ EMULSION \#}}{SO_2 \text{ BASELINE}} \times 100$$

**BASED ON CARBON CONVERSION

Again, as was the case in Examples I–III, Table XII clearly shows the effect of the additives of the present invention on the sulfur emissions when these emulsions are burned as a fuel. Note that sodium was the primary element in the additive.

EXAMPLE V

A final seven oil in water emulsions were prepared using a high sulfur vacuum gas oil as the hydrocarbon component of the emulsion. The compositional characteristics of the emulsions are set forth below in Table XIII.

TABLE XIII

| | FUEL CHARACTERISTICS | | | | | | |
|---|---|---|---|---|---|---|---|
| | BASELINE EMULSION | EMULSION #23 | EMULSION #24 | EMULSION #25 | EMULSION #26 | EMULSION #27 | EMULSION #28 |
| ADDITIVE/SULFUR (MOLAR/RATIO) | — | 0.005 | 0.012 | 0.015 | 0.50 | 0.10 | 0.18 |
| Na (% molar) | 0 | 95.4 | 95.4 | 95.4 | 95.4 | 95.4 | 95.4 |
| K (% molar) | 0 | 0.7 | 0.7 | 0.7 | 0.7 | 0.7 | 0.7 |
| Li (% molar) | 0 | 1.4 | 1.4 | 1.4 | 1.4 | 1.4 | 1.4 |
| Mg (% molar) | 0 | 2.5 | 2.5 | 2.5 | 2.5 | 2.5 | 2.5 |
| LHV (BTU/LB) | 13320 | 13320 | 13320 | 13320 | 13320 | 13320 | 12619 |
| VOL % OF FUEL | 75 | 75 | 75 | 75 | 75 | 75 | 71 |
| VOL % OF WATER | 25 | 25 | 25 | 25 | 25 | 25 | 29 |
| WT. % OF SULFUR | 1.8 | 1.8 | 1.8 | 1.8 | 1.8 | 1.8 | 1.7 |

These emulsions were combusted under the operating conditions set forth in Table XIV.

TABLE XIV

| | OPERATING CONDITIONS | | | | | | |
|---|---|---|---|---|---|---|---|
| | BASELINE EMULSION | EMULSION #23 | EMULSION #24 | EMULSION #25 | EMULSION #26 | EMULSION #27 | EMULSION #28 |
| FEED RATE (LB/H) | 54 | 54 | 54 | 54 | 54 | 54 | 57 |
| THERMAL INPUT (MMBTU/H) | 0.75 | 0.75 | 0.75 | 0.75 | 0.75 | 0.75 | 0.75 |
| FUEL TEMPERATURE (°F.) | 149 | 148 | 77 | 79 | 147 | 147 | 149 |
| STEAM/FUEL RATIO (W/W) | 0.15 | 0.15 | 0.15 | 0.15 | 0.15 | 0.15 | 0.05 |
| STEAM PRESSURE (BAR) | 1.5 | 1.5 | 1.5 | 1.5 | 1.5 | 1.5 | 1.5 |
| MEAN DROPLET SIZE (μm) | 14 | 14 | 14 | 14 | 14 | 14 | 14 |

The combustion characteristics are summarized in the Table XV below.

TABLE XV

| | COMBUSTION CHARACTERISTICS | | | | | | |
|---|---|---|---|---|---|---|---|
| | BASELINE EMULSION | EMULSION #23 | EMULSION #24 | EMULSION #25 | EMULSION #26 | EMULSION #27 | EMULSION #28 |
| $CO_2$ (vol. %) | 13.5 | 13.6 | 13.4 | 13.5 | 13.5 | 13.6 | 13.6 |
| CO (ppm) | 10 | 10 | 15 | 10 | 12 | 20 | 10 |
| $O_2$ (vol. %) | 2.9 | 2.8 | 2.9 | 3.0 | 2.8 | 2.7 | 2.8 |
| $SO_2$ (ppm) | 880 | 832 | 770 | 704 | 458 | 92 | 28 |
| $SO_2$ (LB/MMBTU) | 1.2 | 1.2 | 1.1 | 1.0 | 0.6 | 0.1 | 0.04 |
| $SO_3$ (ppm) | 10 | 8 | 6 | 6 | 3 | 2 | 2 |
| NOx (ppm) | 230 | 210 | 200 | 210 | 200 | 200 | 180 |
| *$SO_2$ REDUCTION (%) | — | 5.5 | 12.5 | 20.0 | 43.5 | 89.6 | 96.8 |

TABLE XV-continued

| | COMBUSTION CHARACTERISTICS | | | | | | |
|---|---|---|---|---|---|---|---|
| | BASELINE EMULSION | EMULSION #23 | EMULSION #24 | EMULSION #25 | EMULSION #26 | EMULSION #27 | EMULSION #28 |
| **COMBUSTION EFFICIENCY (%) | 99.9 | 99.9 | 99.9 | 99.9 | 99.9 | 99.9 | 99.9 |

$$*SO_2\ \text{REDUCTION}\ (\%) = \frac{SO_2\ \text{BASELINE} - SO_2\ \text{EMULSION}\ \#}{SO_2\ \text{BASELINE}} \times 100$$

**BASED ON CARBON CONVERSION

Once again the effect of the additives on the sulfur oxide emissions is clearly demonstrated. As the ratio of additive to sulfur increases the combustion efficiency of the emulsified hydrocarbon fuels improves to 99.9%. $SO_2$ and $SO_3$ emission levels improves as the additive to sulfur ratio increases. As can be seen from emulsion numbers 25, 26, 27 and 28, the efficiency of $SO_2$ removal increases as the additive to sulfur ratio increases. In addition, the sulfur oxide emissions in LB/MMBTU for emulsions 25–28 are equal to or less than that obtained when burning No. 6 fuel oil.

EXAMPLE VI

Major component of ash produced when burning these emulsified fuels such as emulsions No. 15, No. 16 and No. 17 was reported as 3 $MgO.V_2O_5$ (magnesium orthovanadate) whose melting point is 2174° F. Magnesium orthovanadate is a very well known corrosion inhibitor for vanadium attack in combustion systems. Therefore, ashes from emulsions burnt using additives consisting of elements selected from the group of $Ca^{++}$, $Ba^{++}$, $Mg^{++}$ and $Fe^{+++}$ or mixtures thereof and ashes from emulsions burnt using additives consisting of elements selected from the group of $Na^{+}$, $K^{+}$, $Li^{+}$ and $Mg^{++}$, where $Mg^{++}$ is the primary element will render high temperature-corrosion free combustion. Such high temperature corrosion is normally caused, in liquid hydrocarbon combustion, by vanadium low melting point compounds.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for controlling sulfur-oxide formation and emissions when burning a combustible fuel prepared from a hydrocarbon containing sulfur comprising:

(a) providing a sulfur containing hydrocarbon having the following chemical and physical properties:
C wt.% of 78.2 to 85.5;
H Wt.% of 9.0 to 10.8;
O wt.% of 0.2 to 1.3;
N wt.% of 0.50 to 0.70;
S wt.% of 2 to 4.5;
Ash wt.% of 0.05 to 0.33;
Vanadium, ppm of 50 to 1000;
Nickel, ppm of 20 to 500;
Iron, ppm of 5 to 60;
Sodium, ppm of 30 to 200;
Gravity, °API of 1.0 to 12.0;
Viscosity (CST): 122° F. of 1,000 to 5,100,000; 210° F. of 40 to 16,000;
LHV (BTU/lb) of 15,000 to 19,000; and
Asphaltenes wt.% of 9.0 to 15.0;

(b) forming a hydrocarbon in water emulsion by admixing said hydrocarbon and water with an emulsifier and a water soluble sulfur capturing additive selected from the group consisting of $Na^{+}$, $K^{+}$, $Li^{+}$, $Ca^{++}$, $Ba^{++}$, $Mg^{++}$, $Fe^{+++}$ and mixtures thereof so as to form an oil in water emulsion having a water content of from about 5–40 vol.%, an oil droplet size of from about 10–60 μm and a molar ratio amount of additive to sulfur in said hydrocarbon of greater than or equal to 0.050 in order to reduce the amount of sulfur emissions produced during subsequent burning as a liquid fuel;

(c) heating said optimized oil in water emulsion natural liquid fuel to a temperature of 20 to 80° C. and atomizing said fuel with a diluent selected from the group consisting of steam and air wherein said steam is at a pressure of 2 to 6 Bar in a steam to fuel ratio of 0.05 to 0.5 and said air is at a pressure of 2 to 7 Bar in an air to fuel ratio of 0.05 to 0.4;.and (d) burning said atomized fuel whereby $SO_2$ emission levels of less than or equal to 1.50 lb/MMBTU are obtained.

2. A process according to claim 1 wherein said fuel temperature is 20 to 60° C., said steam pressure is 2 to 4 Bar, said steam to fuel ratio is 0.05 to 0.4, said air pressure is 2 to 4 Bar and said air to fuel ratio is 0.05 to 0.3.

3. A process according to claim 1 wherein said molar ratio of additive to sulfur is greater than or equal to 0.100 in said hydrocarbon in water emulsion.

4. A process according to claim 1 wherein said emulsifier additive is selected from the group consisting of anionic surfactants, non-ionic surfactants, cationic surfactants and mixtures of cationic and non-ionic surfactants.

5. A process according to claim 4 wherein said non-ionic surfactants are selected from the group consisting of ethoxylated alkyl phenols, ethoxylated alcohols, ethoxylated sorbitan esters and mixtures thereof.

6. A process according to claim 4 wherein said cationic surfactants are selected from the group consisting of the hydrochlorides of fatty diamines, imidazolines, ethoxylated amines, amido-amines, quaternary ammonium compounds and mixtures thereof.

7. A process according to claim 4 wherein said anionic surfactants are selected from the group consisting of long chain carboxylic, sulfonic acids and mixtures thereof.

8. A process according to claim 1 wherein said emulsifier additive is non-ionic surfactant with a hidrophillic-lipophilic balance of greater than 13.

9. A process according to claim 8 wherein said non-ionic surfactant is nonylphenol oxylated with 20 ethylene oxide units.

10. A process according to claim 7 wherein said anionic surfactant is selected from the group consisting of alkylaryl sulfonate, alkylaryl sulfate and mixtures thereof.

11. A process according to claim 1 wherein said emulsifier additive is present in an amount of about between 0.1 to 5% by weight based on the total weight of the oil in water emulsion.

12. A process according to claim 1 wherein the burning of said optimized oil in water emulsions leads to a substantial decrease of sulfur trioxide formation thus preventing corrosion of heat transfer surfaces due to sulfuric acid condensation.

13. A process according to claim 2 wherein the burning of said optimized oil in water emulsion leads to the formation of high melting point ashes thus preventing corrosion of heat transfer surfaces due to vanadium attack.

* * * * *

UNITED STATES PATENT AND TRADEMARK OFFICE

CERTIFICATE OF CORRECTION

PATENT NO. : 4,834,775

DATED : May 30, 1989

INVENTOR(S) : DOMINGO P. RODRIGUEZ ET AL.

It is certified that error appears in the above-identified patent and that said Letters Patent is hereby corrected as shown below:

Column 16, claim 13, line 4, change the dependency from "claim 2" to read --claim 1--.

Signed and Sealed this

Thirteenth Day of March, 1990

*Attest:*

JEFFREY M. SAMUELS

*Attesting Officer*

*Acting Commissioner of Patents and Trademarks*